US007813684B2

(12) United States Patent
Yamaji et al.

(10) Patent No.: US 7,813,684 B2
(45) Date of Patent: Oct. 12, 2010

(54) TRANSFERRING AND FIXING APPARATUS AND IMAGE FORMING APPARATUS INCLUDING THE SAME

(75) Inventors: Hiroyuki Yamaji, Nara (JP); Yukikazu Kamei, Chiba (JP); Atsushi Tanaka, Kashihara (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 401 days.

(21) Appl. No.: 11/700,199

(22) Filed: Jan. 31, 2007

(65) Prior Publication Data

US 2007/0183820 A1 Aug. 9, 2007

(30) Foreign Application Priority Data

Feb. 7, 2006 (JP) ..... 2006-030200

(51) Int. Cl.
*G03G 15/16* (2006.01)

(52) U.S. Cl. ..... 399/307; 399/302; 399/329

(58) Field of Classification Search ..... 399/307, 399/302, 308, 328, 329; 219/216, 469–471
See application file for complete search history.

(56) References Cited

U.S. PATENT DOCUMENTS

| | | | | |
|---|---|---|---|---|
| 6,088,565 | A | 7/2000 | Jia et al. | |
| 6,868,251 | B2 * | 3/2005 | Pirwitz | 399/329 |
| 7,031,648 | B2 | 4/2006 | Takashi et al. | |
| 2002/0051659 | A1 | 5/2002 | Baba et al. | |
| 2004/0037595 | A1 * | 2/2004 | Takashi et al. | 399/307 |
| 2004/0234290 | A1 * | 11/2004 | Tomatsu | 399/67 |
| 2005/0025537 | A1 * | 2/2005 | Echigo et al. | 399/329 |
| 2006/0018679 | A1 * | 1/2006 | Ishino et al. | 399/94 |
| 2006/0120776 | A1 | 6/2006 | Takashi et al. | |

FOREIGN PATENT DOCUMENTS

| | | | |
|---|---|---|---|
| JP | 6-175513 | A | 6/1994 |
| JP | 09-197838 | A | 7/1997 |
| JP | 2000-194205 | A | 7/2000 |
| JP | 2000-347520 | A | 12/2000 |
| JP | 2002-108121 | A | 4/2002 |
| JP | 2002-148979 | A | 5/2002 |
| JP | 2004-145260 | A | 5/2004 |
| JP | 2004-212844 | A | 7/2004 |
| JP | 2004-341346 | A | 12/2004 |

* cited by examiner

*Primary Examiner*—David P Porta
*Assistant Examiner*—Benjamin Schmitt
(74) *Attorney, Agent, or Firm*—Birch, Stewart, Kolasch & Birch, LLP

(57) ABSTRACT

A transferring and fixing apparatus includes a transferring and fixing member and a pressure member in close and pressing contact with each other, forming a transferring and fixing region therebetween. A fused toner image held and heated by the transferring and fixing member is transferred and fixed into in the transferring and fixing region onto a recording paper fed to the transferring and fixing region, an end portion of the transferring and fixing region where the recording paper is fed is set to have a highest pressure in the transferring and fixing region. With this arrangement the present invention prevents micro offset phenomenon in a transferring and fixing process of toner into a recording paper in a simultaneous transferring and fixing mode, thereby achieving high picture quality.

2 Claims, 6 Drawing Sheets

BACKGROUND ART

TRANSFERRING AND FIXING APPARATUS AND IMAGE FORMING APPARATUS INCLUDING THE SAME

This Nonprovisional application claims priority under 35 U.S.C. §119(a) on Patent Application No. 030200/2006 filed in Japan on Feb. 7, 2006, the entire contents of which are hereby incorporated by reference.

FIELD OF THE INVENTION

The present invention relates to a transferring and fixing apparatus in which a toner image is first formed on a transferring and fixing member, and the toner is heated on the transferring and fixing member, and then the toner image is transferred to a recording material and is fixed onto the material. The present invention also relates to an image forming apparatus including the transferring and fixing apparatus.

BACKGROUND OF THE INVENTION

In many of conventional image forming apparatuses of electrophotography mode, such as a photocopier, a printer or a facsimile, a toner image is first formed on a photoconductor, and the toner image is then transferred to a recording paper by application of electric field. After that, a fixing apparatus heats up the toner image and the recording paper, so that the toner image is fixed to the paper permanently. The fixing apparatus used in such an image forming apparatus is generally constituted of a heating roller and a pressure roller, and a recording paper on which the toner image has been transferred is fed between a fixing nip section provided between two rollers, so that the toner image is fixed onto the recording paper by heat and pressure.

Another well-known fixing mode of image forming apparatus is so-called a simultaneous transferring and fixing mode. In this method, the toner image is formed on the surface of a photoconductor, and then is transferred to an intermediate transfer member. The toner image is heated on the intermediate transfer member, and then is transferred to a recording paper and is fixed thereto at the same time.

The simultaneous transferring and fixing mode is disclosed, for example, in Document 1 (Japanese Unexamined Patent Publication Tokukai 2000-194205 (published on Jul. 14, 2000)). As described therein, this mode allows transfer of toner image onto a recording paper by a non-electrostatic manner (such as heat), and therefore hardly causes degradation of image due to disturbance of electric field. With this advantage this mode ensures high picture quality.

The fixing apparatus of simultaneous transferring and fixing mode disclosed in Document 1, that is, the transferring and fixing apparatus is structured as follows. The transferring and fixing member includes an intermediate layer, which is not less than 0.25 mm, more preferably not less than 1 mm in thickness, on its base, and an outermost layer with a small surface energy is provided on the intermediate layer. The outermost plane of the member is covered by silicone rubber, fluorocarbon rubber, or fluorocarbon polymer. The transferring and fixing member is constituted of a belt or a roller-structure body. The pressure member pressed into the transferring and fixing member is constituted of a roller-structure body. In the case where the transferring and fixing member is a belt-structure body, a roller containing a heat source is provided to be opposed to the pressure roller, and a fixing nip section is formed between the transferring and fixing member and the pressure roller.

The conventional fixing mode which carries out fixing and transfer separately is almost immune to a stain on the surface of fixing member, or partial loss of image, which occurs when the toner image formed on the recording paper is transferred onto the surface of the fixing member in the fixing process. This defect is easily prevented if the detachment performance of the surface of fixing member with respect to the toner used is fully ensured, and the temperature is optimally set.

On the other hand, in the simultaneous transferring and fixing mode, it is necessary to ensure complete transfer of the toner image formed on the transferring and fixing member onto the recording paper in the transfer fixing nip section. If the toner image is somehow not to be completely transferred onto the recording paper and some toner is left on the transferring and fixing member, some kind of image defect occurs. Further, the residue toner may be brought into contact with the recording paper again by the rotation of the transferring and fixing member, which makes a stain on the paper.

In the simultaneous transferring and fixing mode, the transfer of toner from the transferring and fixing member to the recording paper is carried out by heat. Therefore, to solve the foregoing problem, it is necessary to ensure adhesion between the recording paper and the surface of the transferring and fixing member to enable the toner to be completely transferred from the transferring and fixing member to the recording paper.

For example, Document 1 improves the adhesion between the transferring and fixing member and the recording paper (the subservience of the surface of the transferring and fixing member with respect to the recording paper) in the following manner. The thickness of intermediate elastic layer formed on the base of the transferring and fixing member has a thickness of 1.0 mm or greater. To ensure sufficient detachment performance of toner from the transferring and fixing member, it is necessary to coat the outermost plane with fluorocarbon resin or the like. However, the coated surface of the transferring and fixing member is hard, and the adhesion with the recording paper greatly decreases.

Further, as described, in the simultaneous transferring and fixing mode, the toner is transferred onto the recording paper by heat, and therefore the transfer performance especially for a dot image decreases, and thereby various defects such as degradation of image is more likely to occur.

SUMMARY OF THE INVENTION

The present invention is made in view of the foregoing circumstances and an object is to provide a transferring and fixing apparatus with improved contact of paper surface and a transferring and fixing member in the process of transferring and fixing toner into a recording paper in a simultaneous transferring and fixing mode. The present invention also provides and an image forming apparatus including the transferring and fixing apparatus. With the foregoing effect, the present invention improves transferring and fixing property of the toner from the transferring and fixing member to the recording paper in the toner transfer of halftone images or the like in which the toner transfer property have been not ensured. The present invention thus provides transferring and fixing apparatus and an image forming apparatus including the transferring and fixing apparatus ensuring high picture quality and does not cause toner stains etc. on the transferring and fixing member and/or other components.

To solve the foregoing problems, the present invention provides a transferring and fixing apparatus in which a transferring and fixing member and a pressure member are in close and pressing contact with each other, forming a transferring and fixing region therebetween, and a fused toner image held and heated by the transferring and fixing member is transferred and fixed into the transferring and fixing region onto a recording paper fed to the transferring and fixing region, either of an end portion of the transferring and fixing region where the recording paper is fed or an end portion of the transferring and fixing region where the recording paper is discharged is set to have a highest pressure in the transferring and fixing region.

The foregoing transferring and fixing apparatus makes it possible to optimize the pressure distribution in the transferring and fixing region with respect to transition of the temperature of toner image in the transferring and fixing region in the simultaneous transferring and fixing mode. Therefore, micro offset phenomenon can be successfully reduced. With this effect the toner stains etc. on the recording paper due to the micro offset phenomenon can be reduced even in a dot image in which adjacent toner particles are not firmly coupled. The present invention thus achieves high picture quality. Further, by providing the transferring and fixing region, it is possible to reduce the gross load given to the transferring and fixing member or the pressure member, and therefore it also has an effect of prolonging the life of the transferring and fixing member or the pressure member.

More specifically, when the toner is fused on the transferring and fixing member, the temperature of toner layer on the transferring and fixing roller is rapidly cooled down after fed into the transferring and fixing region as it comes in contact with a recording paper. Thereafter, as the recording paper moves on the transferring and fixing region, the temperature of the toner layer is increased again as heated by the transferring and fixing member. Therefore, the temperature of toner layer is high in an end portion of the transferring and fixing region where the recording paper is fed, and in another end portion of the transferring and fixing region where the recording paper is discharged.

A general recording paper for the electrophotography mode has an irregular surface because of the paper fiber. For this reason, in the simultaneous transferring and fixing mode in which toner is transferred and fixed from the transferring and fixing roller into a recording paper by heat and pressure, the fixation of toner with respect to the paper greatly depends on the adhesion between the surface of the transferring and fixing roller and the recording paper. More specifically, if the adhesion between the two surface and the paper decreases, the toner of the toner image on the transferring and fixing roller is not fully transferred onto the recording paper, and a part of the toner image remains on the transferring and fixing roller. This is a defect so-called a micro offset phenomenon. The micro offset phenomenon can be prevented by increasing the adhesion between the transferring and fixing member and the recording paper, that is, it is effective to increase the pressure of the transferring and fixing region in the state where the toner is fully fused, in other words, the temperature of toner is high.

In view of this, the transferring and fixing apparatus is arranged so that the pressure becomes highest in either of the paper feed end or the paper discharge end of the transferring and fixing region. With this arrangement, the portion where the temperature of the toner image becomes highest in the transferring and fixing region substantially coincides with the portion having the highest pressure in the transferring and fixing region. On this account the micro offset phenomenon is reduced and desirable transferring and fixing function is ensured in the simultaneous transferring and fixing mode.

The present invention also provides a transferring and fixing apparatus in which a transferring and fixing member and a pressure member are in close and pressing contact with each other, forming a transferring and fixing region therebetween, and a fused toner image held and heated by the transferring and fixing member is transferred and fixed into the transferring and fixing region onto a recording paper fed to the transferring and fixing region, a portion of the highest temperature of the toner image in the transferring and fixing region is a portion having a highest pressure in the transferring and fixing region.

The foregoing transferring and fixing apparatus makes it possible to optimize the pressure distribution in the transferring and fixing region with respect to transition of the temperature of toner image in the transferring and fixing region in the simultaneous transferring and fixing mode. Therefore, micro offset phenomenon can be successfully reduced. With this effect the toner stains etc. on the recording paper due to the micro offset phenomenon can be reduced even in a dot image in which adjacent toner particles are not firmly coupled. The present invention thus achieves high picture quality. Further, by providing the transferring and fixing region, it is possible to reduce the gross load given to the transferring and fixing member or the pressure member, and therefore it also has an effect of prolonging the life of the transferring and fixing member or the pressure member.

A general recording paper for the electrophotography mode has an irregular surface because of the paper fiber. For this reason, in the simultaneous transferring and fixing mode in which toner is transferred and fixed from the transferring and fixing roller into a recording paper by heat and pressure, the fixation of toner with respect to the paper greatly depends on the adhesion between the surface of the transferring and fixing roller and the recording paper. More specifically, if the adhesion between the two surface and the paper decreases, the toner of the toner image on the transferring and fixing roller is not fully transferred onto the recording paper, and a part of the toner image remains on the transferring and fixing roller. This is a defect so-called a micro offset phenomenon. The micro offset phenomenon can be prevented by increasing the adhesion between the transferring and fixing member and the recording paper, that is, it is effective to increase the pressure of the transferring and fixing region in the state where the toner is fully fused, in other words, the temperature of toner is high.

In view of this, the transferring and fixing apparatus is arranged so that the pressure becomes highest in either of the paper feed end or the paper discharge end of the transferring and fixing region. With this arrangement, the portion where the temperature of the toner image becomes highest in the transferring and fixing region substantially coincides with the portion having the highest pressure in the transferring and fixing region. On this account the micro offset phenomenon is reduced and desirable transferring and fixing function is ensured in the simultaneous transferring and fixing mode.

The present invention also provides a transferring and fixing apparatus in which a transferring and fixing member and a pressure member are in close and pressing contact with each other, forming a transferring and fixing region therebetween, and a fused toner image held and heated by the transferring and fixing member is transferred and fixed into the transferring and fixing region onto a recording paper fed to the transferring and fixing region, the transferring and fixing member and the pressure member rotate in the same direction, and the peripheries of the transferring and fixing member and the pressure member in close and pressing contact with each other move at different speeds.

The inventors of the present invention attempted an intensive study to find a way of suppressing micro offset phenomenon in a transferring and fixing apparatus having a transferring and fixing member and a pressure member. Then they invented a structure in which the transferring and fixing member and the pressure member rotate in the same direction, and the peripheries of the transferring and fixing member and the pressure member in close and pressing contact with each other move at different speeds, thereby suppressing the micro offset phenomenon.

With this effect the toner stains etc. on the recording paper due to the micro offset phenomenon can be reduced even in a dot image in which adjacent toner particles are not firmly coupled. The present invention thus achieves high picture quality.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 5(*b*) is a graph showing temperature change of the toner layer and pressure distribution in the transferring and fixing region of the transferring and fixing unit of FIG. 2 according to the present embodiment.

DESCRIPTION OF THE EMBODIMENTS

One embodiment of the present invention is described below with reference to figures. In the present embodiment, a color laser printer is used as an image forming apparatus of the present invention.

Figure 1:
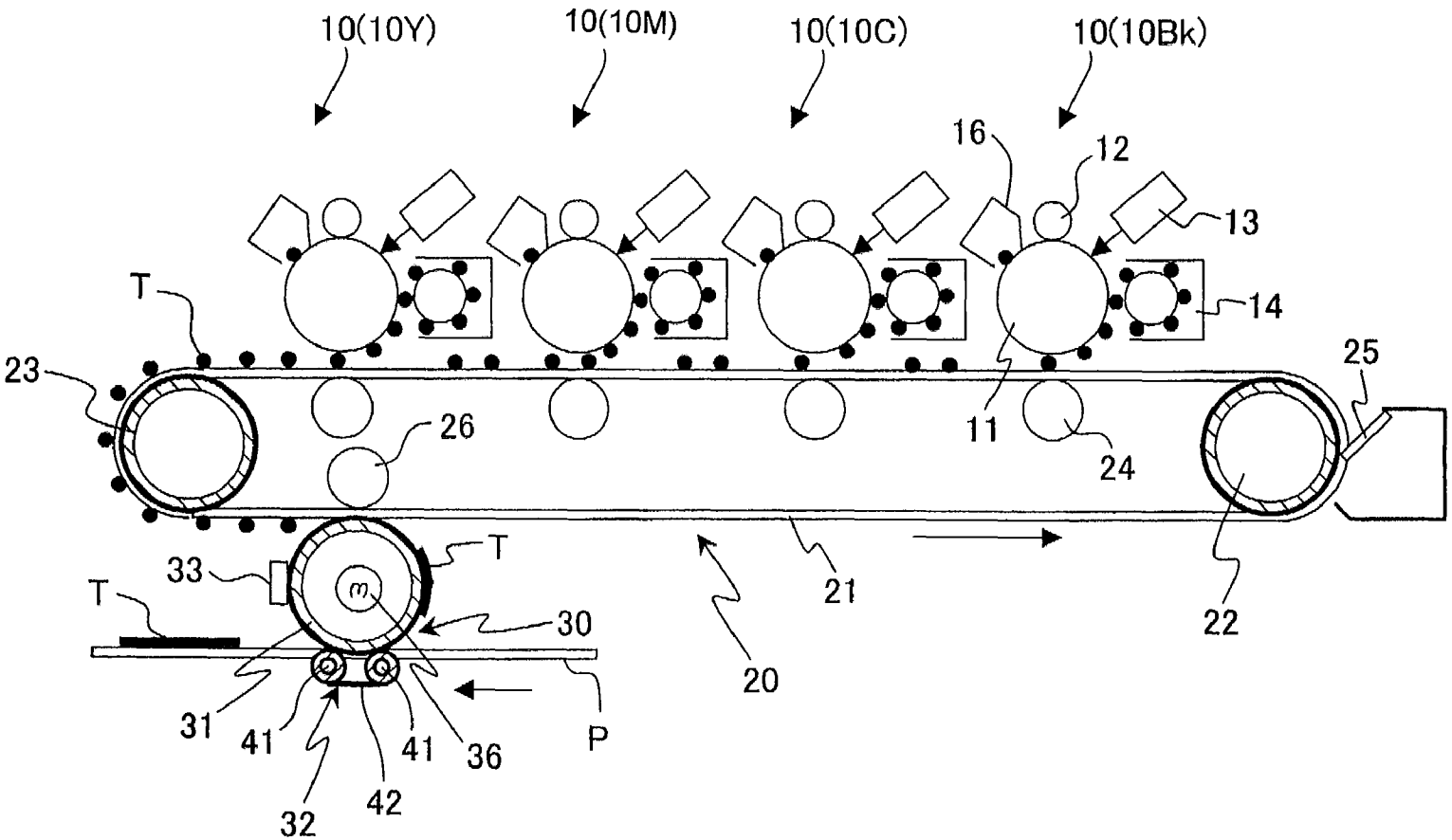
FIG. 1 is a vertical cross-sectional view schematically showing a main part of an image forming apparatus including a transferring and fixing apparatus according to one embodiment of the present invention.

As shown in FIG. 1, the color laser printer according to the present embodiment includes four groups of image forming units 10 (10Bk, 10C, 10M, 10Y) which allow the color laser printer to carry out image forming with four colors; an intermediate transferring unit 20; and a transferring and fixing unit 30.

Each image forming unit 10 has a photoconductor drum (toner image carrier) 11, which is surrounded by a charging roller 12, a laser light emitter 13, a developer 14 and a cleaner 16. The developers 14 of the four image forming units 10 (10Bk, 10C, 10M, 10Y) contain toner of yellow(Y), magenta (M), cyan(C), and black(Bk), respectively.

The intermediate transferring unit 20 is constituted of an intermediate transferring belt 21, an intermediate transferring belt driving roller 22, an intermediate transferring belt tension roller 23, a primary transfer roller 24, an intermediate transferring belt cleaning unit 25 and a secondary transfer backup roller 26.

The intermediate transferring belt 21 is set around the intermediate transferring belt driving roller 22 and the intermediate transferring belt tension roller 23, and is driven by driving means (not shown) and an intermediate transferring belt driving roller 22.

An intermediate transferring belt 21 includes a base material (not shown) and a release layer (not shown) formed on the base material. The base material is made of polyimide, polycarbonate or the like. Note that, as described later, the intermediate transferring belt 21 has to have heat-resistant property to some extent because it comes in contact with the transferring and fixing roller 31 which is heated. In this view, polyimide is more preferable because of its heat-resistance. The base material is made 50 to 100 μm in thickness. As mentioned above, the temperature of the intermediate transferring belt 21 will be increased by the heat from the transferring and fixing roller 31, and therefore the heat capacity of the intermediate transferring belt 21 is preferably small, more specifically, a smaller thickness is preferable.

Further, the volume resistance of the base material of the intermediate transferring belt 21 is set to a predetermined value so as to carry out the following operation. That is, the primary transfer roller 24 is supplied with a voltage to transfer toner from the photoconductor drum 11 to the intermediate transferring belt 21 in the primary transfer nip section. Specifically, the resistance is set to a value not more than $10^{13}$ Ω·cm.

Further, as described later, the toner being transferred from the intermediate transferring belt 21 to the transferring and fixing roller 31 in the secondary transfer section is heated by the heat from the transferring and fixing roller 31, and the toner may be adhered to the intermediate transferring belt 21. Therefore, as mentioned above, the intermediate transferring belt 21 preferably includes a release layer on its base material.

The release layer may be a tube layer of PFA (copolymer of tetrafluoroethylene and perfluoroalkyl vinyl ether), or may be coated by a fluorocarbon resin such as PFA or PTFE (polytetrafluoroethylene). Further, in order to adjust the volume resistance or surface resistance of the intermediate transferring belt 21, giving conductivity to the release layer is effective. The release layer is made several μm to several tens of μm in thickness. In consideration of durability etc., a thickness of 5 to 30 μm is more desirable for the release layer.

The primary transfer roller 24 is opposed to the photoconductor drum 11 via the intermediate transferring belt 21, and applies an electric field between the photoconductor drum 11 and the intermediate transferring belt 21 so as to transfer toner from the photoconductor drum 11 onto the intermediate transferring belt 21. The intermediate transferring belt cleaning unit 25 is disposed to be opposed to the intermediate transferring belt driving roller 22 via the intermediate transferring belt 21, and cleans the transfer residue toner off the intermediate transferring belt 21. The secondary transfer backup roller 26 is disposed to be opposed to the transferring and fixing roller 31 of the transferring and fixing unit 30 via the intermediate transferring belt 21, and transfers toner from the intermediate transferring belt 21 to the transferring and fixing roller 31.

Figure 2:
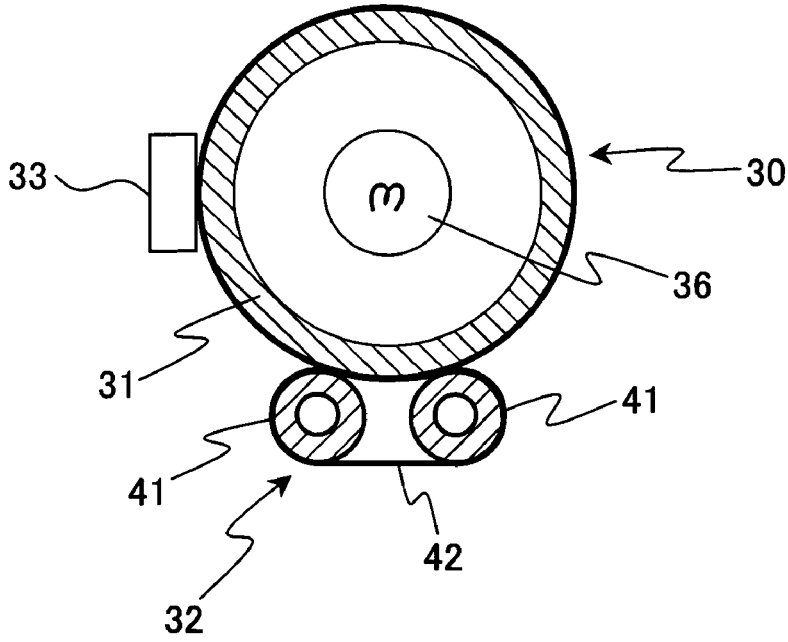
FIG. 2 is a vertical cross-sectional view showing a magnified view of the transferring and fixing unit of FIG. 1.

As shown in FIG. 2, the transferring and fixing unit (transferring and fixing apparatus) 30 includes a transferring and fixing roller 31, a pressure member 32 and a temperature detecting member 33. The transferring and fixing roller 31 is a roller of 50 mm in outer diameter, and includes a heater lamp 36 serving as an internal heat source for heating the transferring and fixing roller 31. The pressure member 32 includes two pressure rollers 41 and a fixing belt 42 set around the pressure rollers 41, and is in close and pressing contact with the transferring and fixing roller 31. The temperature detecting member 33 detects the temperature of the transferring and fixing roller 31.

Figure 3:
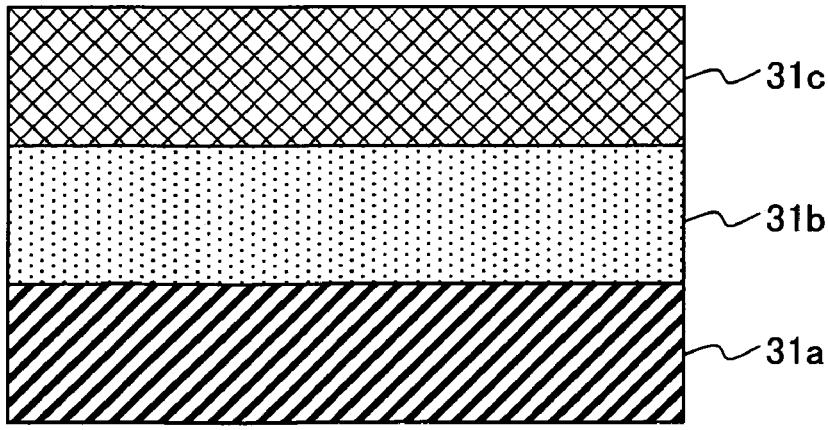
FIG. 3 is a vertical cross-sectional view showing a lamination structure of the transferring and fixing roller of FIG. 1.

As shown in FIG. 3, the transferring and fixing roller 31 is constituted of a base material 31*a* on which an elastic layer 31*b* and a release layer 31*c* are stacked on each other in this order. The base material 31*a* is a metal core made of aluminum, stainless steel, iron or copper.

The surface of elastic layer 31*b* allows the surface of transferring and fixing roller 31 holding the fused toner image to closely come in contact with the irregular surface of the recording paper in the transfer fixing nip section (transferring and fixing region) between the transferring and fixing roller 31 and the pressure member 32, thus allowing the toner image to be completely transferred to the recording paper. The elastic layer 31*b* further enables adjustment of the transfer fixing nip section in terms of paper width in traveling direction, that is the gap between the transferring and fixing roller 31 and the pressure member 32, so that the toner is fully interfused with the recording paper. The fixing strength is thus ensured. The thickness of the elastic layer 31*b* ranges from several hundreds μm to several mm. Note that, the thickness of the elastic layer 31*b* is preferably adjusted to 2 mm or less because an excessively large thickness results in decrease in energy-saving effect. On the other hand, an excessive small thickness may decrease adhesion of the transferring and fixing roller 31 to the paper surface (the subservience of the surface of the fixing roller 31 with respect to the recording paper). Accordingly, a thickness of approximately 200 μm is required at least.

The release layer 31*c* is formed from a material which allows easy release of toner. For example, the release layer 31*c* may be formed from a tube layer of PFA or the like, or may be coated by a fluorine material such as PFA or PEFE. The release layer 31*c* is made approximately several μm to several tens of μm in thickness.

The pressure roller 41 of the pressure member 32 is a solid or hollow metal roller 15 mm to 20 mm in external diameter made of iron, aluminum, or stainless steel. The fixing belt 42 is a resin belt about 100 μm in thickness made of a heat resistant resin base material such as polyimide, or a metal belt 30 to 50 μm in thickness made of a base metal material of nickel, stainless steel or the like. The fixing belt 42 may also contain a release layer on the periphery of the belt base material. This release layer may be realized by a PFA tube or may be formed by coating the surface of the belt with fluorocarbon resin such as PFA, PTFE or the like. An appropriate distance between the respective axes of the two pressure rollers is 23 mm in the case where the fixing belt 42 has an internal diameter of 30 mm and an external diameter of 15 mm, and the transferring and fixing roller 31 has an external diameter of 50 mm and an internal diameter of 30 mm. This is an example in the case of an arrangement in which the fixing belt 42 is set on the two pressure rollers 41. It is also allowable to provide three or four rollers to loop the fixing belt 42. The distance between the respective axes of the two pressure rollers 41, the external diameters of the pressure rollers 41, the internal diameter of the fixing belt 42 are determined according to the desired state of the fixing belt 42 and the rollers.

The following explains the toner material. The color toner of the present invention is constituted of a binder resin, a coloring agent, wax, charging control agent etc.

Examples of binder resin include polyester, styrene-acryl copolymer, epoxy resin, and polyamide.

The coloring agent may be any general pigment. For example, carbon black for the black toner, C.I.(Color Index) pigment yellow 12, C.I. pigment yellow 17, C.I. pigment yellow 97 or the like may be used for yellow toner. C.I. pigment red 57:1, C.I. pigment red 122 or the like may be used for magenta toner. C.I. pigment blue 15:1, C.I. pigment blue 15:3 or the like may be used for cyan toner.

Further, the transferring and fixing of toner to a paper is carried out without oil by using wax such as low fusing point polypropylene, low fusing point polyethylene or the like which is internally contained. Nigrosin, quaternary ammonium salt or the like are also added as a charging control substance.

The toner thus constituted is further externally supplied with organic/inorganic particles to be given flow property, charging property, cleaning property as required. Inorganic particles may be silica, alumina, or titanium oxide, and organic particles may be polymethyl methacrylate fine powder.

The following explains a process of transferring a toner image formed on a photoconductor drum 11 onto a recording paper via the intermediate transferring belt 21 and the transferring and fixing roller 31, by the image forming apparatus according to the present embodiment.

In each image forming unit 10, a toner image is formed on the surface of the photoconductor drum 11, and these toner images of plural image forming units 10 are sequentially transferred to the intermediate transferring belt 21. More specifically, the surfaces of the photoconductor drums 11 are first evenly charged by the charging roller 12. Next, the surfaces of the photoconductor drums 11 are exposed to laser light by the laser light emitter 13 based on the image information, and electrostatic latent images of different colors are formed on the respective photoconductor drums 11. Thereafter, the electrostatic latent images on the photoconductor drums 11 are developed by the developer 14 to produce toner images.

Then, in the first transfer nip section between the photoconductor drum 11 and the intermediate transferring belt 21, the toner images are sequentially transferred to the intermediate transferring belt 21 by a primary transfer roller 24 having been supplied with a bias voltage opposite in polarity to the toner.

The toner image formed on the intermediate transferring belt 21 is transferred from the intermediate transferring belt 21 to the transferring and fixing roller 31 in the secondary transfer nip section constituted of a secondary transfer backup roller 26 on the rear side of the intermediate transferring belt 21, the intermediate transferring belt 21 and the transferring and fixing roller 31.

In this case, the transferring and fixing roller 31 is heated by the heater lamp 36. Meanwhile, the intermediate transferring belt 21 is kept at 50° C. or lower at least at the portion coming in contact with the photoconductor drum 11, considering thermal influence or the like to the photoconductor drum 11. Therefore, the temperature of the toner on the toner layer on the secondary transfer nip section varies in the boundary in contact with the transferring and fixing roller 31 and in the boundary in contact with the intermediate transferring belt 21. The internal temperature of toner layer thus varies.

More specifically, the temperature of the boundary between the toner layer and the transferring and fixing roller 31 is increased to be at least equal to or greater than the glass transition temperature of toner, as the toner layer comes in contact with the transferring and fixing roller 31 heated to a high temperature. The toner layer therefore has some kind of adhesion force to the transferring and fixing roller 31. On the other hand, the temperature of boundary between the toner layer and the intermediate transferring belt 21 is lower than the temperature of the boundary between the toner layer and the transferring and fixing roller 31. Therefore, the adhesion force of the toner layer to the intermediate transferring belt 21 is weaker than that to the transferring and fixing roller 31, so that the toner layer on the intermediate transferring belt 21 is transferred onto the transferring and fixing roller 31.

In the secondary transfer nip section, the effect of electric field generated between the intermediate transferring belt 21 and the transferring and fixing roller 31 may be used to assist thermal transfer of toner.

More specifically, if the amount of adhered toner is large (the thickness of the toner layer is large) as in the case of secondary or tertiary colors, the heat affected to the toner layer may be insufficient and the temperature of the boundary between the toner layer and the intermediate transferring belt 21 may become excessively low. In this case the effect of secondary transfer may not be sufficient. To eliminate this defect, the secondary transfer backup roller 26 is supplied with a voltage equal in polarity to the toner. As a result, an electric field is generated between the transferring and fixing roller 31 and the intermediate transferring belt 21, and the electric field serves to transfer the toner from the intermediate transferring belt 21 to the transferring and fixing roller 31. This method achieves almost 100% efficient toner transfer regardless of the temperature of the intermediate transferring belt 21.

Next, the toner image transferred to the transferring and fixing roller 31 is then transferred to the recording paper. In this case, the transferring and fixing roller 31 heats and melts the toner image. For this operation the transferring and fixing roller 31 is heated by the heater lamp (internal heat source) 36, and the surface temperature is adjusted to an even temperature, approximately 120 to 180° C. An optimal temperature is set according to the material of toner, the process speed, the nip width of the later-mentioned transfer fixing nip section (third transfer nip section) formed between the transferring and fixing roller 31 and the pressure roller 32, the load condition thereof etc.

As described, the toner of the toner image having been transferred on the transferring and fixing roller 31 is further heated on the transferring and fixing roller 31 until sufficiently fused. The pressure member 32 is in close and pressing contact with the transferring and fixing roller 31, and a transfer fixing nip section is formed therebetween. With this arrangement, the toner image fully fused on the recording paper is transferred to the recording paper and is fixed thereto as the recording paper having carried to the transfer fixing nip section by a paper carrying member (not shown) passes between the transferring and fixing roller 31 and the pressure member 32.

The following explains a difference between the transferring and fixing unit (transferring and fixing apparatus) 30 according to the present embodiment and a conventional transferring and fixing unit (transferring and fixing apparatus) in terms of transferring and fixing function.

Figure 4:
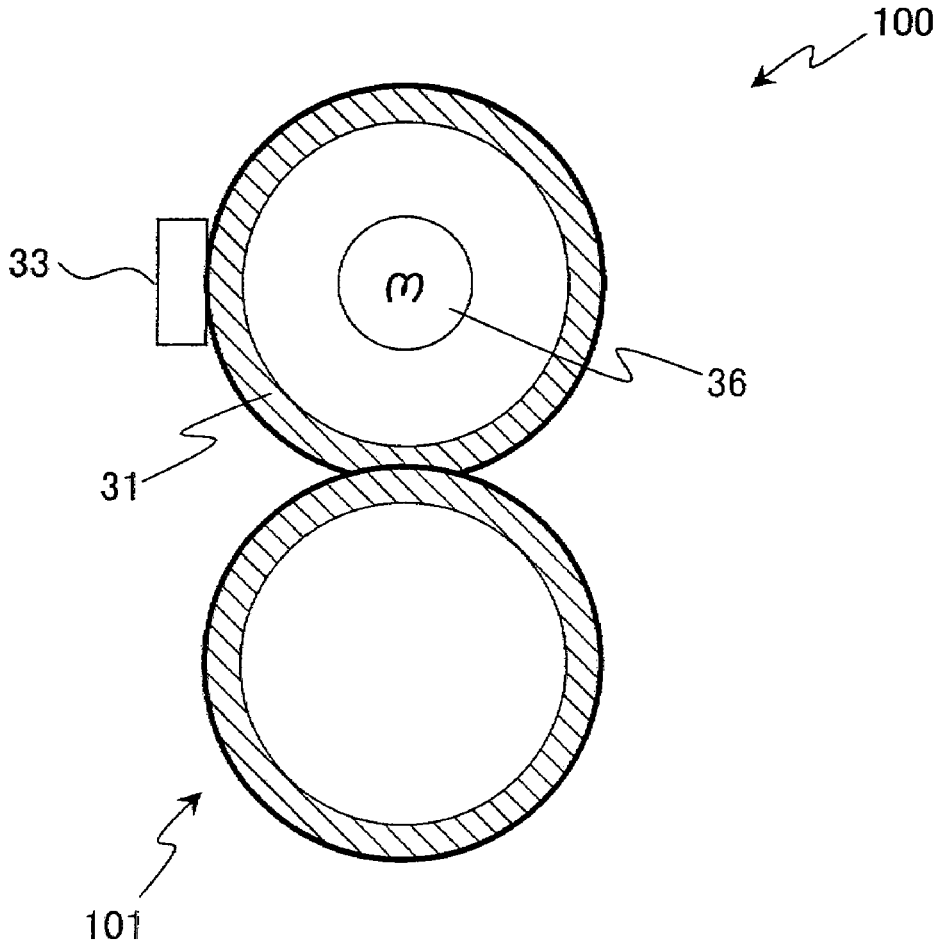
FIG. 4 is a vertical cross-sectional view showing a conventional transferring and fixing unit.

FIG. 4 is a vertical cross-sectional view showing a conventional transferring and fixing unit 100. In this figure, the transferring and fixing roller 31 is identical in structure to that of FIG. 2. The pressure member 101 is constituted of a roller. In the process of simultaneous transferring and fixing performed by the transferring and fixing unit 100, the toner image is heated on the roller 31, and is transferred and fixed to a recording paper in the transfer fixing nip section between the transferring and fixing roller 31 and the pressure member 101 which is in close and pressing contact with the transferring and fixing roller 31.

Figure 5:
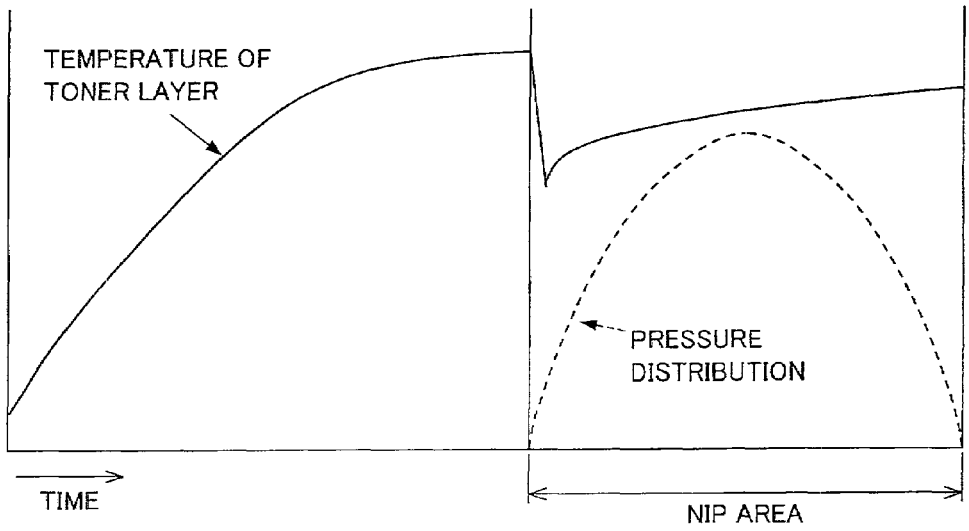
FIG. 5 (a) BACKGROUND ART
FIG. 5(*a*) is a graph showing temperature change of the toner layer and pressure distribution in the transferring and fixing region of the conventional transferring and fixing unit of FIG. 4.
Figure 5:
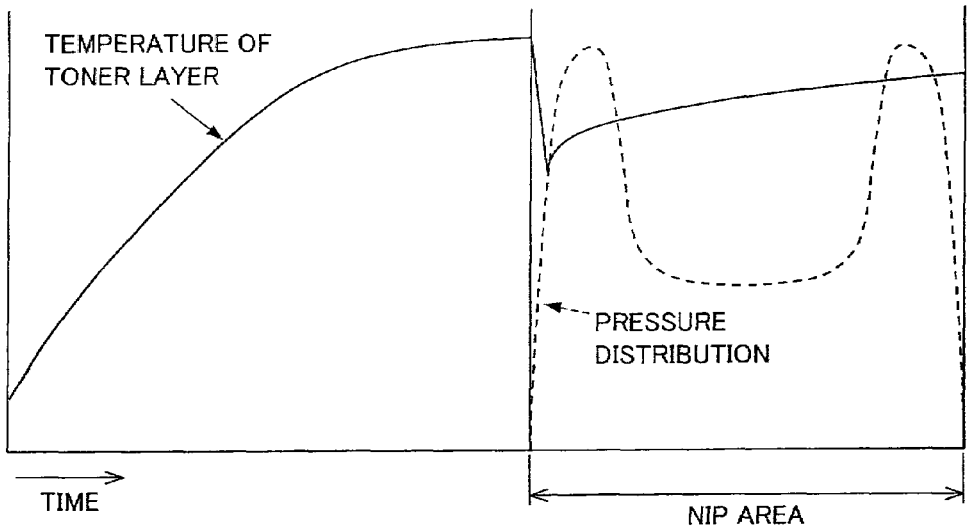

FIG. 5(*a*) is a graph showing a result of analysis of pressure and temperature of a toner layer in the vicinity of the transfer fixing nip section in the transferring and fixing unit 100.

As shown in the figure, in the transferring and fixing unit 100, the temperature of toner layer (toner image) on the transferring and fixing roller 31 is highest before it is fed into the transfer fixing nip section, and the toner layer is rapidly cooled down after fed into the transfer fixing nip section as it comes in contact with a recording paper. Thereafter, as the transfer fixing nip section moves, the temperature of the toner layer is increased again as heated by the transferring and fixing roller 31. Meanwhile, the pressure of transfer fixing nip section is low in an end portion of the transfer fixing nip section where the recording paper is fed, and is highest in the center, and is low in the vicinity of an end portion of the transfer fixing nip section where the recording paper is discharged.

As shown in FIG. 5(*a*), in the transferring and fixing unit 100 having the roller-shaped pressure member 101, the pressure is low in a paper feed end or in a paper discharge end of the transfer fixing nip section of the transfer fixing nip section where the temperature of toner layer is high, and is highest in the center of the transfer fixing nip section where the temperature of toner layer is low.

A general recording paper for the electrophotography mode has an irregular surface because of the paper fiber. For this reason, in the simultaneous transferring and fixing mode in which toner is transferred and fixed from the transferring and fixing roller into a recording paper by heat and pressure, the fixation of toner with respect to the paper greatly depends on the adhesion between the surface of the transferring and fixing roller and the recording paper. More specifically, if the adhesion between the two surface and the paper decreases, the toner of the toner image on the transferring and fixing roller is not fully transferred onto the recording paper, and a part of the toner image remains on the transferring and fixing roller. This is a defect so-called a micro offset phenomenon.

The micro offset phenomenon hardly occurs in the case of forming a so-called a solid image, but it significantly occurs in the case of dot image. More specifically, in the case of forming solid images, adjacent toner particles are firmly coupled, and the entire toner layer is transferred at once. Therefore quality of transfer is ensured even when the adhesion between the transferring and fixing roller and the recording paper is partially decreased.

On the other hand, in the case of transfer of dot images, particularly for a rough dot image constituted of dots of small pixels, the amount of toner constituting the dots is small, and therefore the toner particles constituting the dots are not firmly coupled even though the toner is fully fused on the transferring and fixing roller. If this toner does not completely follow the irregularity of the surface of recording paper, the toner corresponding to the depression parts of the surface of the recording paper sinks down in the depression of the surface of recording paper, and the stress required for transferring and fixing becomes insufficient. As a result, micro offset phenomenon occurs more significantly.

Therefore, to prevent the micro offset phenomenon, it is effective to increase the adhesion between the transferring and fixing roller and the recording paper, that is, it is effective to increase the pressure of the transfer fixing nip section in the state where the toner is fully fused, in other words, the temperature of toner is high.

In the conventional transferring and fixing unit 100, the region where the temperature of toner layer is high does not coincide with the region where the pressure is high, as shown in FIG. 5(*a*). In consideration of the foregoing fact in the transferring and fixing process, the transferring and fixing function of the conventional transferring and fixing unit 100 cannot be ensured in the simultaneous transferring and fixing mode.

On the other hand, the transferring and fixing unit 30 of the present embodiment shown in FIG. 2 includes the pressure member 32 which is arranged so that the fixing belt 42 are set on the two pressure rollers 41 which are in close and pressing contact with transferring and fixing roller 31. Therefore, the pressure of the transfer fixing nip section is high in the vicinity of the insertion end and the discharge end of the transfer fixing nip section, and is low in the center of the transfer fixing nip section. FIG. 5(*b*) shows a graph showing a result of analysis of the temperature of the toner layer in the vicinity of the transfer fixing nip section and the pressure of the transfer fixing nip section in the transferring and fixing unit 30.

As shown in FIG. 5(*b*), in the transferring and fixing unit 30 in which the pressure member 32 is constituted of the two pressure rollers 41 and the fixing belt 42, the pressure of the transfer fixing nip section becomes high in the paper feed end or in the paper discharge end of the transfer fixing nip section of the transfer fixing nip section where the temperature of toner layer is high. That is, the region where the temperature of toner layer is high substantially coincides with the region where the pressure is high. Therefore, the toner layer (toner image) is pressed into the recording paper with more pressure when its temperature is high. Since the adhesion of toner decreases as the temperature and the pressure increases, the toner is more easily interfused into the recording paper. Therefore, in the transferring and fixing unit 30, micro offset phenomenon does not easily occur even in the case of forming dot images. On this account the transferring and fixing unit 30 ensures desirable transferring and fixing function in the simultaneous transferring and fixing mode.

Next, the following explains a test result showing a difference between the transferring and fixing unit 30 according to the present invention and a conventional transferring and fixing unit 100.

In this test, occurrence of micro offset phenomenon was examined for images of 150 to 600 DPI dots in the transferring and fixing unit 30 including a belt-shaped pressure member 32 and in the transferring and fixing unit 100 including a roller-shaped pressure member 101. Note that, in the transferring and fixing unit 30, a 15 kgf load is given to each pressure roller 41 in the direction to which the transferring and fixing roller 31 is pressed. In the transferring and fixing unit 100, a 40 kgf load is given to the pressure member (pressure roller) 101 in the direction to which the transferring and fixing roller 31 is pressed. The test is described below in detail.

First, in the transferring and fixing unit 30 and in the transferring and fixing unit 100, 3 cm×3 cm dot image of 150, 300, 600 DPI were printed only on a portion corresponding to the first round of the transferring and fixing roller 31, and a dot images were transferred onto a recording paper. Next, the toner remaining on the transferring and fixing roller 31 due to the micro offset phenomenon was transferred to the recording paper in the second or later round of the transferring and fixing roller. This recording paper is used as a measurement recording paper. Thereafter, the occurrence of micro offset phenomenon on the portion corresponding to the second or later round of the transferring and fixing roller was measured by a whiteness degree meter. The quantity of micro offset was measured for each of the transferring and fixing unit 30 and the transferring and fixing unit 100.

According to the result, there was no big difference between the transferring and fixing unit 30 and the transferring and fixing unit 100 for the dot image of 150 DPI. However, for the dot image of 300 DPI and the dot image of 600 DPI, the micro offset phenomenon was seen in the transferring and fixing unit 100, but the phenomenon was so little in the transferring and fixing unit 30 that it was invisible. The result is shown in Table 1.

TABLE 1

VISUAL EVALUATION RESULT OF MICRO OFFSET PHENOMENON

| PIXEL SHAPE | 150 DPI | 300 DPI | 600 DPI |
|---|---|---|---|
| CONVENTIONAL ART | ○ | Δ | X |
| EMBODIMENT | ○ | ○ | ○ |

○: INVISIBLE
Δ: SLIGHTLY VISIBLE
X: SIGNIFICANTLY VISIBLE

As shown in the table, a load is added to the pressure member 32 in close and pressing contact with the transferring and fixing roller 31 in a high temperature portion in each of the insertion end and the discharge end of the transfer fixing nip section of the toner layer. By thus increasing pressure in the transfer fixing nip section, micro offset phenomenon can be suppressed.

Note that, the high pressure portion preferably exists in both of the insertion end and the discharge end of the transfer fixing nip section of the toner layer. However, even when it exists only one of them, the transferring and fixing function is superior than the unit in which the high pressure portion exists in the center of the transfer fixing nip section.

Figure 6:
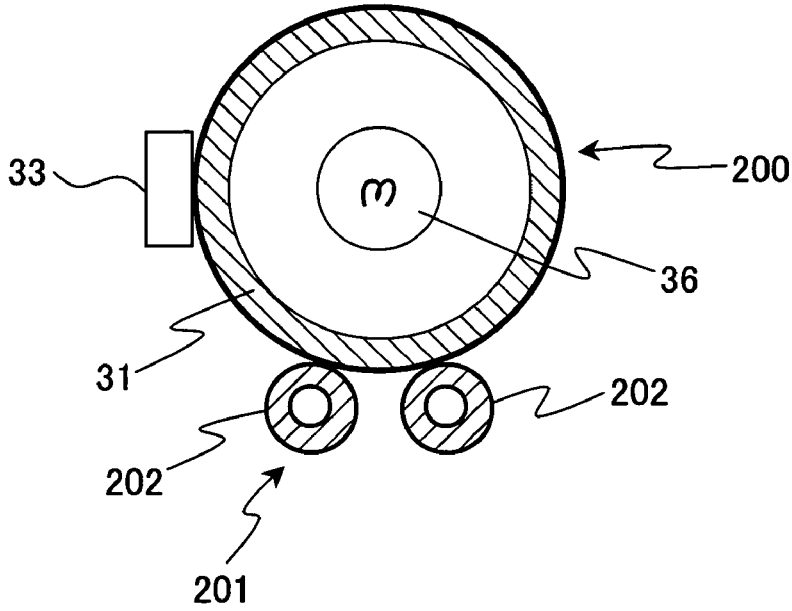
FIG. 6 is a vertical cross-sectional view showing another example of the transferring and fixing unit of FIG. 2.

FIG. 6 shows another example of the transferring and fixing unit according to the present embodiment. The transferring and fixing unit 200 shown in FIG. 6 includes a pressure member 201 instead of the pressure member 32. The transferring and fixing roller 31 is identical in structure to that of FIG. 2, that is, the transferring and fixing roller 31 is a roller member about 50 mm in diameter. The pressure member 201 is constituted of not the fixing belt 42 but two pressure rollers 202 in close and pressing contact with transferring and fixing roller 31, each of which includes a release layer at least on the outer face of its base material. The base material is made of a metal plain tube constituted of a hollow or solid rotation body made of iron, aluminum, stainless steel etc. The release layer can be formed by coating the outer face with a fluorocarbon resin such as PFA tube, PFA, or PTFE. Further, an elastic layer such as silicone rubber, fluorocarbon rubber, or silicone sponge produced by foaming a silicone rubber may be formed between the base material and the release layer.

The outer diameter of each pressure roller is set to 15 mm, and the distance between the two pressure rollers is set to 20 mm to 30 mm, for example.

In the transferring and fixing unit 200, the nip sections between the two pressure rollers 202 and the transferring and fixing roller 31 and the region between the two nip sections serve as transferring and fixing regions. This transferring and fixing unit 200 also has the feature of the transferring and fixing unit 30 above, that is, the temperature of toner layer is high in the insertion end and the discharge end of the toner layer of the transferring and fixing region, and the region where the temperature of toner layer is high substantially coincides with the region where the pressure is high. Therefore, as with the transferring and fixing unit 30, the transferring and fixing unit 200 ensures high transferring and fixing function.

Figure 7:
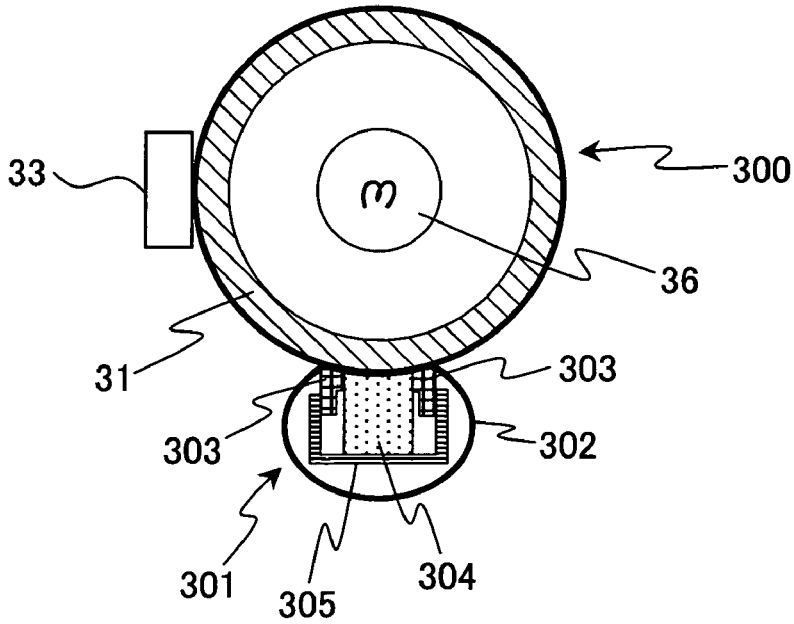
FIG. 7 is a vertical cross-sectional view showing still another example of the transferring and fixing unit of FIG. 2.

FIG. 7 shows still another example of the transferring and fixing unit according to the present invention. The transferring and fixing unit 300 includes a pressure member 301 instead of the pressure member 32. This pressure member 301 includes a sliding belt 302, hard pads 303 and a soft pad 304.

The sliding belt 302 is made of, for example, a polyimide or a polyimide base material coated with high-release material such as PFA. Each of the hard pads 303 is a plate made of a hard metal material, such as aluminum or iron, and extends in the axis direction of the transferring and fixing roller 31. The soft pad 304 is a plate or a bar made of a soft material, for example, an elastic material such as silicone rubber, and extends in the axis direction of the transferring and fixing roller 31. The hard pads 303 are disposed on the both sides of the soft pad 304 in terms of the recording paper traveling direction. These three members are held by a holding element 305, and pressed into the transferring and fixing roller 31 via the sliding belt 302.

The hard pads 303 and the soft pad 304 are adjacently provided in the transferring and fixing region in a direction from the paper feed end to the paper discharge end, and the soft pad 304 has a wider width than each of the hard pads 303 in terms of this direction.

The sliding belt 302 is so structured as to be pressed into the transferring and fixing roller 31 by the soft pad 304 and the hard pads 303. The sliding belt 302 is rotated by transferring and fixing roller driving means (not shown) along with the rotation of the transferring and fixing roller 31.

Due to the provision of the soft pad 304 and the hard pads 303 on the both sides of the soft pad 304 in the pressure member 301, the pressure of the transferring and fixing region between the transferring and fixing roller 31 and the pressure member 301 is high in the insertion end and the discharge end of the transferring and fixing region, and is low in the center of the transferring and fixing region. Therefore, as with the transferring and fixing unit 30, the transferring and fixing unit 300 ensures high transferring and fixing function.

The structure of the transferring and fixing unit 300 is effective to perform the simultaneous transferring and fixing mode in a relatively small transferring and fixing region, as this structure makes it possible to optimize the plane pressures of the insertion end, the discharge end, and the center of the toner layer of the transferring and fixing region in the relatively small transferring and fixing region.

Figure 8:
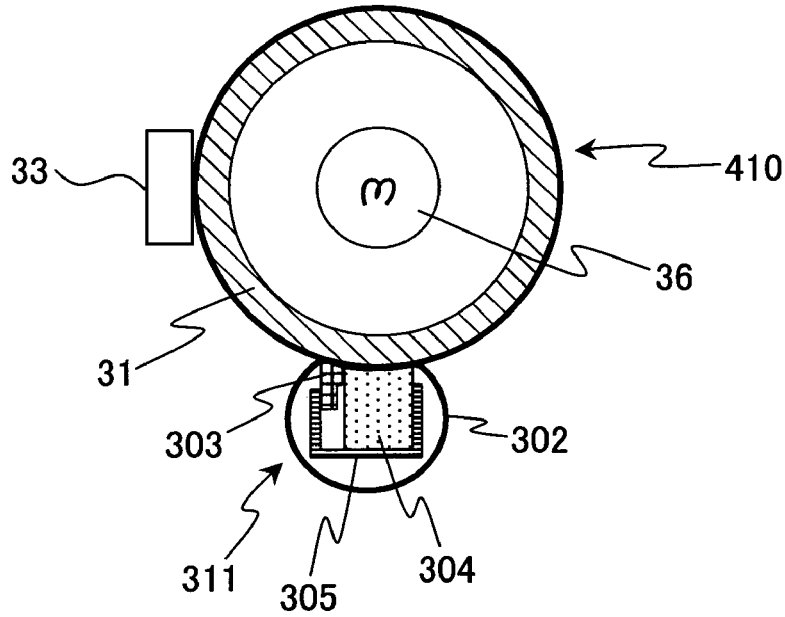
FIG. 8 is a vertical cross-sectional view showing a structure of the transferring and fixing unit of FIG. 7 in which only the pressure in the insertion-end of the transferring and fixing region increases.
Figure 9:
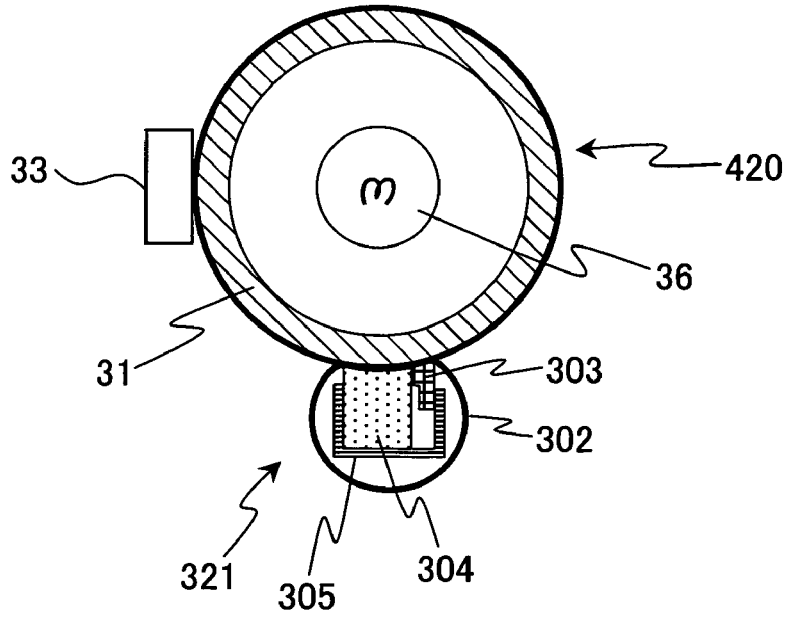
FIG. 9 is a vertical cross-sectional view showing another structure of the transferring and fixing unit of FIG. 7 in which only the pressure in the discharge-end of the transferring and fixing region increases.

Further, in the transferring and fixing unit 300, the pressure is high in the insertion end and in the discharge end of the transferring and fixing region, but an arrangement in which only one of the insertion end and the discharge end of the transferring and fixing region is high is also allowable. FIGS. 8 and 9 show such structures. More specifically, in the transferring and fixing unit 410 shown in FIG. 8, the pressure member 311 is arranged so that a single hard pad 303 is disposed downstream in the paper traveling direction (paper discharge side) of the soft pad 304 so as to increase the pressure only in the discharge end of the transferring and fixing region. On the other hand, in the transferring and fixing unit 420 shown in FIG. 9, the pressure member 321 is arranged so that a single hard pad 303 is disposed upstream in the paper traveling direction (paper insertion side) of the soft pad 304 so as to increase the pressure only in the insertion end of the transferring and fixing region.

The following explains a test result of checking occurrence of the micro offset phenomenon in the transferring and fixing unit 100 including the transferring and fixing roller 31 and the pressure member 101, in which a speed variation is given between the transferring and fixing roller 31 and the pressure member 101. Note that, the speed of the transferring and fixing roller 31 or the pressure member 101 indicates a movement speed (linear velocity) of the periphery of the transferring and fixing roller 31 or the periphery of the pressure member (pressure roller) 101. The transferring and fixing roller 31 is driven by the transferring and fixing roller driving motor (not shown) via the transferring and fixing roller driving gear (not shown), and the pressure member 101 is adjusted in gear ratio by the transferring and fixing roller driving gear to be driven at a desired speed.

The transferring and fixing roller 31 is made of a π38 aluminum core which thereon has a 1 mm silicone layer of JIS-A20 degree, and the upper face of the silicone layer is coated with a 30 μm thick PFA tube. The pressure roller serving as the pressure member 101 is made of a π38 aluminum core which thereon has a 1 mm silicone layer of JIS-A30 degree, and the upper face of the silicone layer is coated with a 30 μm thick PFA tube.

With the transferring and fixing unit 100 having such a combination of rollers, the influence of speed difference to the micro offset phenomenon was examined by the same evaluation method as that of the previous test. The load for pressing the pressure member 101 into the transferring and fixing roller 31 was 40 kgf in this test.

In this test, the micro offset phenomenon was clearly seen in the dot images of 300DPI and of 600DPI when no speed variation was given between the transferring and fixing roller 31 and the pressure member 101. On the other hand, when the 5% speed variation was given so that the pressure member 101 was driven slower than the transferring and fixing roller 31, the micro offset phenomenon was decreased to an invisible degree even in a dot image of 600DPI. In contrast, when the pressure member 101 was adjusted to be driven 5% faster than the transferring and fixing roller 31, the micro offset phenomenon was decreased so that it was invisible in a dot image of 300DPI, and was almost invisible in a dot image of 600DPI. This result is shown in Table 2.

TABLE 2

| | SPEED VARIATION | | | | |
|---|---|---|---|---|---|
| | 5% | 3% | NIL | −3% | −5% |
| EVALUATION OF MICRO OFFSET EVALUATION | ○ | ○ | x | Δ | Δ |
| EXTENSION OF IMAGE | SLIGHTLY VISIBLE | INVISIBLE | NONE | INVISIBLE | SLIGHTLY VISIBLE |

* A POSITIVE % DENOTES CONDITION WHERE V1 (SPEED OF TRANSFERRING AND FIXING ROLLER) > V2 (SPEED OF PRESSURE MEMBER)
x: VISIBLE IN BOTH 300 DPI IMAGES AND 600 DPI IMAGES
Δ: VISIBLE IN 600 DPI IMAGE
○: INVISIBLE EVEN IN 600 DPI

As can be seen in Table 2, it is effective to give speed variation between the movement speed (linear velocity) of the transferring and fixing roller 31, which is denoted by V1, and the movement speed (linear velocity) of the pressure member 101, which is denoted by V2. However, an excessively large speed variation causes, for example, if assume that the speed of the transferring and fixing roller is excessively decreased, extension of image. On the other hand, if the speed is excessively increased, the image shrinks. Therefore, the speed variation is preferably not more than 5%, more preferably not more than 3%.

Further, the speed variation is preferably set as $$V1>V2$$

With this condition the effect of decrease of micro offset phenomenon becomes more effective in the transferring and fixing unit 100 of FIG. 4.

The principle of effect of decrease of micro offset phenomenon by giving the speed variation between the transferring and fixing roller 31 and the pressure member 101 has not been completely found out. It is however assumed that the speed variation between the transferring and fixing roller 31 and the pressure member 101 upon the transfer of toner from the transferring and fixing roller 31 to the recording paper causes some slippage effect between the surface of the recording paper and the surface of the transferring and fixing roller 31, and this in some degree contributes to increase the transfer of toner into the recording paper.

The present invention is applicable to an image forming apparatus containing a transferring and fixing apparatus of a simultaneous transferring and fixing mode, such as a photocopier or a printer.

As described, the foregoing transferring and fixing apparatus may be arranged so that the pressure member includes a belt member and two pressure rollers, each of two pressure rollers is in close and pressing contact with the transferring and fixing member via the belt member, and the belt member is set around the two pressure rollers.

With this arrangement, a pressure member useful for a transferring and fixing apparatus having the foregoing transferring and fixing function can be realized with a simple structure.

The foregoing transferring and fixing apparatus may be arranged so that the pressure member includes two pressure rollers, which are disposed with a certain distance and are in close and pressing contact with the transferring and fixing member.

With this arrangement, a pressure member useful for a transferring and fixing apparatus having the foregoing transferring and fixing function can be realized with a simpler structure.

The foregoing transferring and fixing apparatus may be arranged so that the pressure member has a belt member, a hard pad and a soft pad softer than the hard pad, the hard pad and the soft pad are in close and pressing contact with the transferring and fixing member via the belt member, the belt member is rotated while sliding on the hard pad and the soft pad.

With this arrangement, it is possible to realize a pressure member useful for a transferring and fixing apparatus performing a simultaneous transferring and fixing mode with a relatively small transferring and fixing region.

the foregoing transferring and fixing apparatus may be arranged so that the pressure member includes a plurality of pressure rollers in close and pressing contact with the transferring and fixing member so as to form the transferring and fixing region.

With this arrangement, a pressure member useful for a transferring and fixing apparatus having the foregoing transferring and fixing function can be realized with a simple structure.

The foregoing transferring and fixing apparatus may be arranged so that the speeds of the peripheries of the transferring and fixing member and the pressure member are determined on condition that:

$$V1>V2$$

where V1 denotes a speed at which the periphery of the transferring and fixing member moves and V2 denotes a speed at which the periphery of the pressure member moves.

With regard to the structure in which the peripheries of the transferring and fixing member and the pressure member in close and pressing contact with each other move at different speeds, the inventors of the present invention further found a condition: V1>V2, where V1 denotes a speed at which the periphery of the transferring and fixing member moves and V2 denotes a speed at which the periphery of the pressure member moves. With this condition the micro offset phenomenon in the simultaneous transferring and fixing mode can be more effectively suppressed.

With this effect the toner stains etc. on the recording paper due to the micro offset phenomenon can be reduced even in a dot image in which adjacent toner particles are not firmly coupled. The present invention thus achieves high picture quality.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A transferring and fixing apparatus, comprising:

a transferring and fixing member;

a pressure member forming a transferring and fixing region between the pressure member and the transferring and fixing member, the pressure member including a belt member, a hard pad, a soft pad softer than the hard pad, the hard pad and the soft pad in close and pressing contact with the transferring and fixing member via the belt member, the belt member rotated while sliding on the hard pad and the soft pad, and a second hard pad, harder than the soft pad, disjoined from said hard pad and adjacent to the soft pad, the belt member sliding on the hard pad, the soft pad, and the second hard pad, wherein a fused toner image held and heated by the transferring and fixing member is transferred and fixed in the transferring and fixing region onto a recording paper fed to the transferring and fixing region, and an end portion of the transferring and fixing region where the recording paper is fed is set to have a highest pressure in the transferring and fixing region.

2. A transferring and fixing apparatus, comprising:

a transferring and fixing member;

a pressure member forming a transferring and fixing region between the pressure member and the transferring and fixing member, the pressure member including a belt member, a hard pad, a soft pad softer than the hard pad, the hard pad and the soft pad in close and pressing contact with the transferring and fixing member via the belt member, the belt member rotated while sliding on the hard pad and the soft pad, the hard pad and the soft pad being adjacently provided in the transferring and fixing region in a direction from a paper feed portion to a paper discharge portion, the soft pad having a wider width than the hard pad in said direction, and a second hard pad disposed adjacent to the soft pad and disjoined from the hard pad in said direction, the belt member sliding on the hard pad, the soft pad, and the second hard pad, wherein a fused toner image held and heated by the transferring and fixing member is transferred and fixed in the transferring and fixing region onto a recording paper fed to the transferring and fixing region, and an end portion of the transferring and fixing region where the recording paper is fed is set to have a highest pressure in the transferring and fixing region.

* * * * *